US011101550B2

(12) United States Patent
Lee et al.

(10) Patent No.: US 11,101,550 B2
(45) Date of Patent: Aug. 24, 2021

(54) BASE STATION ANTENNA

(71) Applicant: ACE TECHNOLOGIES CORPORATION, Incheon (KR)

(72) Inventors: Yong Sang Lee, Changnyeong-gun (KR); Ho Yong Kim, Incheon (KR); Tack-Gyu Kim, Incheon (KR); Jae Hoon Tae, Incheon (KR); Bayanmunkh Enkhbayar, Incheon (KR); Kyu Hoon Lee, Bucheon-si (KR)

(73) Assignee: ACE TECHNOLOGIES CORPORATION, Incheon (KR)

( * ) Notice: Subject to any disclaimer, the term of this patent is extended or adjusted under 35 U.S.C. 154(b) by 532 days.

(21) Appl. No.: 15/901,159

(22) Filed: Feb. 21, 2018

(65) Prior Publication Data

US 2018/0254544 A1 Sep. 6, 2018

(30) Foreign Application Priority Data

Feb. 21, 2017 (KR) ..... 10-2017-0022648
Mar. 21, 2017 (KR) ..... 10-2017-0035223

(51) Int. Cl.

| | |
|---|---|
| ***H01Q 1/24*** | (2006.01) |
| ***H01Q 15/14*** | (2006.01) |
| ***H01Q 21/00*** | (2006.01) |
| ***H01Q 21/26*** | (2006.01) |
| ***H01Q 19/10*** | (2006.01) |

(52) U.S. Cl.

CPC ..... *H01Q 1/246* (2013.01); *H01Q 15/14* (2013.01); *H01Q 19/10* (2013.01); *H01Q 21/00* (2013.01); *H01Q 21/26* (2013.01)

(58) Field of Classification Search

CPC ..... H01Q 21/26; H01Q 15/14; H01Q 1/246; H01Q 19/18; H01Q 19/185; H01Q 21/06; H01Q 1/526

See application file for complete search history.

(56) References Cited

U.S. PATENT DOCUMENTS

| | | | | |
|---|---|---|---|---|
| 2,998,605 | A * | 8/1961 | Orlando | H01Q 19/185 343/848 |
| 5,838,282 | A * | 11/1998 | Lalezari | H01Q 21/26 343/727 |
| 2004/0140942 | A1* | 7/2004 | Gotti | H01Q 13/10 343/810 |
| 2009/0096700 | A1* | 4/2009 | Chair | H01Q 21/26 343/797 |
| 2010/0001921 | A1 | 1/2010 | Copeland | |

(Continued)

FOREIGN PATENT DOCUMENTS

| | | | |
|---|---|---|---|
| CN | 201233958 | Y | 5/2009 |
| DE | 60110869 | T2 | 10/2005 |

(Continued)

OTHER PUBLICATIONS

The Office Action from Intellectual Property India_ Application No. 201844005967, dated Nov. 2, 2020.

*Primary Examiner* — Ricardo I Magallanes

(57) ABSTRACT

A base station antenna is disclosed. The disclosed antenna includes: a reflector plate made of a metal material; a multiple number of radiators formed on the reflector plate and forming one or more arrays; and conductive rods positioned on both sides of each of the radiators, where the conductive rods are formed in parallel with the arrays formed by the radiators.

15 Claims, 10 Drawing Sheets

(56) References Cited

U.S. PATENT DOCUMENTS

| | | | | |
|---|---|---|---|---|
| 2014/0184464 | A1 | 7/2014 | Ilnar et al. | |
| 2015/0381229 | A1* | 12/2015 | Tzanidis | H01Q 1/50 455/73 |

FOREIGN PATENT DOCUMENTS

| | | | |
|---|---|---|---|
| KR | 10-2008-0028003 | A | 3/2008 |
| KR | 10-1548915 | B | 9/2015 |
| KR | 10-1609665 | B | 4/2016 |

* cited by examiner

BASE STATION ANTENNA

CROSS-REFERENCE TO RELATED APPLICATIONS

This application claims the benefit of Korean Patent Application No. 10-2017-0022648, filed with the Korean Intellectual Property Office on Feb. 21, 2017, and Korean Patent Application No. 10-2017-0035223, filed with the Korean Intellectual Property Office on Mar. 21, 2017, the disclosures of which are incorporated herein by reference in their entirety.

BACKGROUND

1. Technical Field

The present invention relates to an antenna, more particularly to a base station antenna.

2. Description of the Related Art

A base station antenna is an antenna that communicates with terminals located within a pre-designated region and is typically installed at a high altitude, such as on a high-rise building or a mountain, for transmitting and receiving signals to and from the terminals.

Generally, a base station antenna has a multiple number of radiators arranged over the upper surface of a reflector plate made from a metallic material. For the radiators, dual-polarized radiators are often used, which radiate dual polarizations of +45° and −45°. In using radiators with dual polarization, it is important to ensure a sufficient cross polarization ratio, which represents the isolation between the dual polarizations of +45° and −45°.

SUMMARY OF THE INVENTION

Addressing the problem in the related art referred to above, an aspect of the present invention is to provide a base station antenna that includes a metal patch and conductive rods.

To achieve the objective above, an embodiment of the present invention provides a base station antenna that includes: a reflector plate made of a metal material; a multiple number of radiators formed on the reflector plate and forming one or more arrays; and conductive rods positioned on both sides of each of the radiators, where the conductive rods are formed in parallel with the arrays formed by the radiators.

The base station antenna can further include a metal patch positioned on an upper side of each of the radiators.

Each of the radiators can include: a balun part in which a multiple number of holes are formed; and a radiating part formed extending from the balun part, where the metal patch can be positioned such that the middle of the metal patch overlaps the middle of the respective radiator.

The area of the metal patch can be larger in size than the area of an upper surface of the balun part.

The radiating part can be formed such that it extends along a direction that is not parallel with the reflector plate.

The multiple number of radiators can be supplied with feed signals by way of a coupling method from a feed line that passes through a hole of the balun part.

The reflector plate can have a ground potential.

The multiple radiators can radiate dual polarizations.

Another embodiment of the present invention provides a base station antenna that includes: a reflector plate made of a metal material; a multiple number of radiators formed on the reflector plate and forming one or more arrays; and a metal patch positioned on an upper side of each of the multiple number of radiators, where each of the radiators includes a balun part in which a multiple number of holes are formed and a radiating part formed extending from the balun part, and where the metal patch is positioned such that the middle of the metal patch overlaps the middle of the respective radiator, and the metal patch has a larger area than the upper surface of the balun part.

The base station antenna can further include conductive rods positioned on both sides of each of the radiators.

The conductive rods can be formed in parallel with the arrays formed by the multiple radiators.

The radiating part can be formed such that it extends along a direction that is not parallel with the reflector plate.

The multiple number of radiators can be supplied with feed signals by way of a coupling method from a feed line that passes through a hole of the balun part.

The reflector plate can have a ground potential.

The multiple radiators can radiate dual polarizations.

An embodiment of the present invention can provide the advantage of improved cross polarization ratio.

Additional aspects and advantages of the present invention will be set forth in part in the description which follows, and in part will be obvious from the description, or may be learned by practice of the invention.

DETAILED DESCRIPTION OF THE INVENTION

Figure 1:
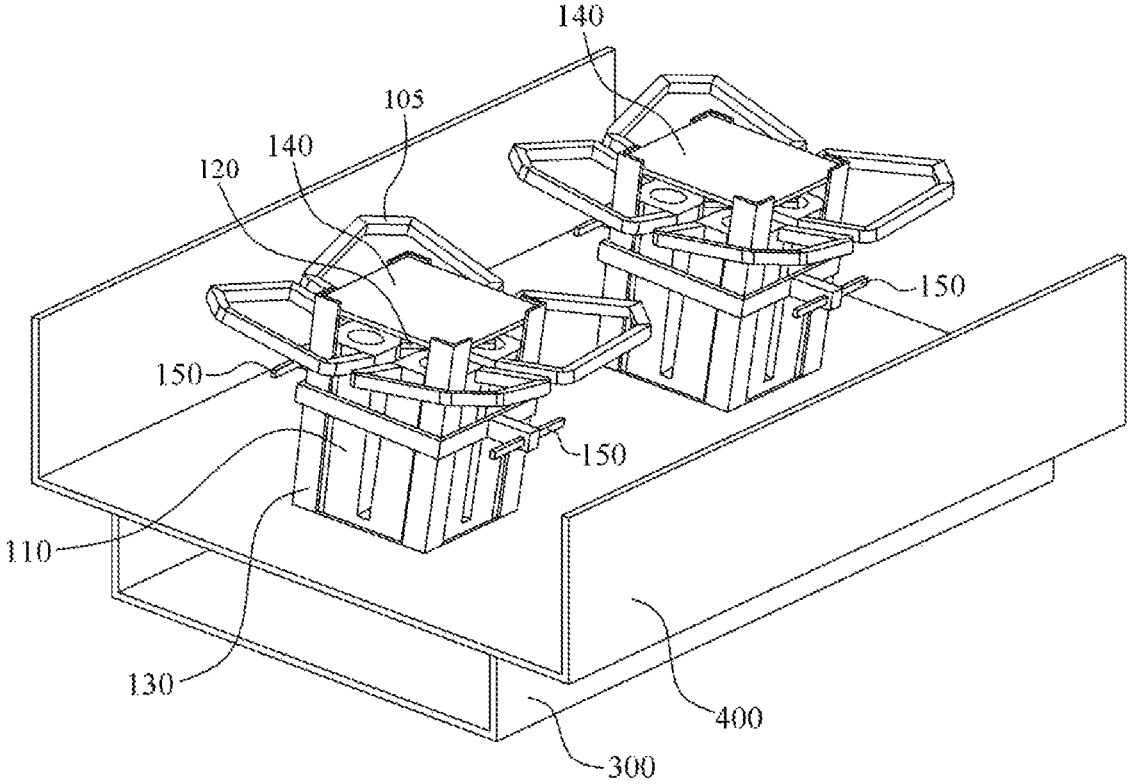
FIG. 1 is a perspective view of a base station antenna according to an embodiment of the present invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention. In describing the drawings, similar reference numerals are used for similar elements.

While such terms as "first" and "second," etc., may be used to describe various elements, such elements must not be limited to the above terms. The above terms are used only to distinguish one element from another. For example, a first element may be referred to as a second element without departing from the scope of rights of the present invention, and likewise a second element may be referred to as a first element. Certain embodiments of the present invention are described below in more detail with reference to the accompanying drawings.

FIG. 1 is a perspective view of a base station antenna according to an embodiment of the present invention.

Referring to FIG. 1, a base station antenna according to an embodiment of the invention can include first radiators 100, a first reflector plate 400, and a second reflector plate 300. The first reflector plate 400 and second reflector plate 300 can be made from metal materials and can have a ground potential. A reflector plate connects to the ground of the radiators and serves to improve the front-to-back ratio of the base station antenna by reflecting the radiated waves emitted by the radiators. Abase station antenna according to an embodiment of the invention can be implemented using just the first reflector plate 400 only or can include two reflector plates as shown in the drawings to further improve the cross polarization ratio. Here, the cross polarization ratio represents the isolation between polarizations for radiators that generate dual polarizations of +45° and −45°.

The second reflector plate 300 can be formed under the first reflector plate 400, and the first radiators 100 can be arranged over the first reflector plate 400. The first reflector plate 400 and second reflector plate 300 can have side walls formed on both sides. Also, the first reflector plate 400 and the second reflector plate 300 can be connected electrically.

The first radiator 100 can penetrate through the first reflector plate 100 and be electrically connected with the second reflector plate 300. One or more first radiators 100 can be formed as necessary, and the first radiators 100 can be arranged to form one or more arrays.

Also, a circuit board 200 can be formed under the second reflector plate 300, where circuits that connect to the first radiators 100 can be formed on the circuit board 200. The circuits can supply the first radiators 100 with feed signals.

Figure 2:
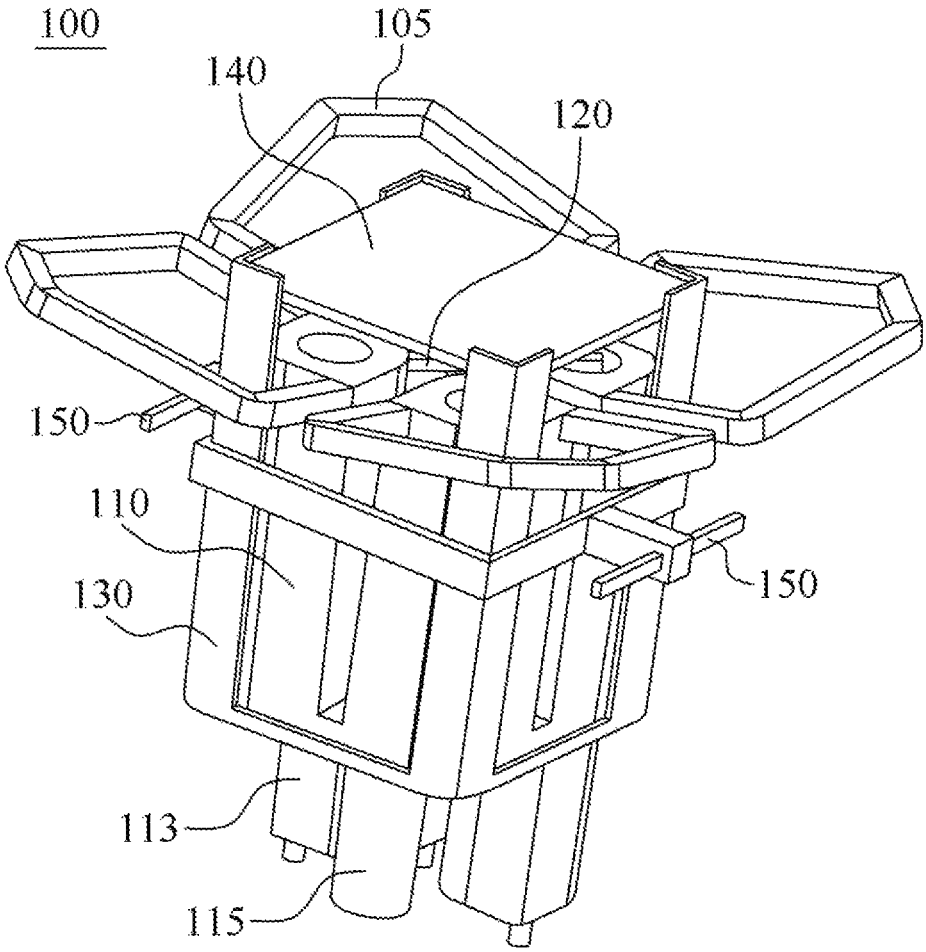
FIG. 2 is a perspective view of a first radiator in a base station antenna according to an embodiment of the present invention.
Figure 3:
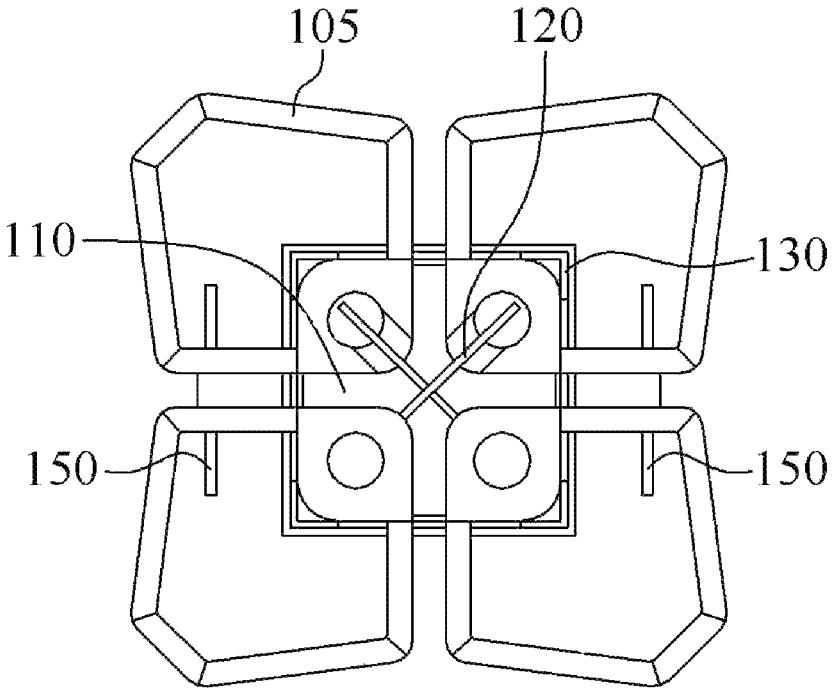
FIG. 3 is a plan view of a first radiator in a base station antenna according to an embodiment of the present invention, with the metal patch removed.

FIG. 2 is a perspective view of a first radiator in a base station antenna according to an embodiment of the present invention, and FIG. 3 is a plan view of the first radiator in a base station antenna according to an embodiment of the present invention but with the metal patch removed.

Referring to FIG. 1 and FIG. 2, a first radiator 100 can include a balun part 110 and a radiating part 105, conductive rods 150 can be positioned on both sides of the first radiator 100, and a metal patch 140 can be positioned on the upper side of the first radiator 100. Also, a dielectric 130 can be formed on the first radiator 100 for securing the metal patch 140 and the conductive rods 150.

Referring to FIG. 2 and FIG. 3, a balun part 110 for feeding can be formed on the first radiator 100. The balun part 110 may have holes formed therein, with feed lines 120 passing through the holes. The balun part 110 can include feed parts 113 and a ground part 115. A feed line 120 that passes through the balun part 110 can supply feed signals to the first radiator 100 via coupling with the balun part 110.

The first radiator 100 may have the dielectric 130 formed thereon. The first radiator 100 can be positioned penetrating through the first reflector plate 400, and the dielectric 130 may contact the first reflector plate 400 such that the first radiator 100 is electrically separated from the first reflector plate 400.

When two reflector plates are used, the balun part 110 of the first radiator 100 can penetrate through the first reflector plate 100 and be electrically connected with the second reflector plate 300. One or more first radiators 100 can be formed as needed, where the first radiators 100 can be arranged to form one or more arrays.

At the upper end of the balun part 110, radiating parts 105 can be formed extending along a sideward direction. The radiating parts 105 can have a shape that allows easy emission of RF signals, for example having the shape of a multiple number of rings. In particular, the radiating part 105 of a base station antenna according to an embodiment of the invention can be formed extending along a direction that is not parallel with the reflector plates 300, 400. That is, the radiating parts 105 can be formed such that they extend from the upper end of the balun part 110 at an arbitrary angle with respect to the reflector plates 300, 400. Thus, the radiating part 105 of a base station antenna according to an embodiment of the invention can have an inclined structure that is not parallel with the reflector plates, thus providing a structure that is advantageous in improving the cross polarization ratio.

Conductive rods 150 can be positioned on both sides of the balun part 110 of a first radiator 100. A conductive rod 150 may be made from a conductive material and may be positioned in parallel with the reflector plates 300, 400. In particular, the conductive rods 150 can be positioned to be in parallel with the arrays formed by the arrangement of the first radiators 100. The positioning of the conductive rods 150 in parallel with the arrays formed by the first radiators 100 allows the base station antenna according to an embodiment of the present invention to have an improved cross polarization ratio.

Figure 4:
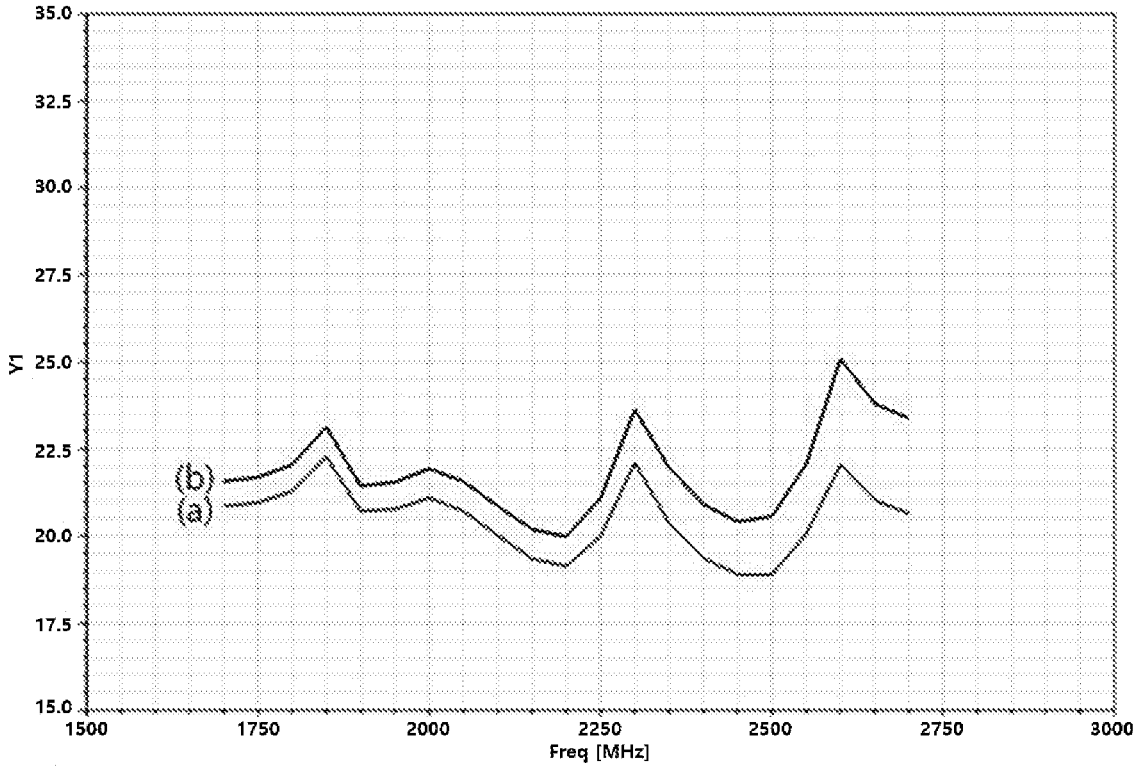
FIG. 4 is a graph representing the cross polarization ratio of a first radiator according to the placement of the conductive rods.

FIG. 4 is a graph representing the cross polarization ratio of a first radiator according to the placement of the conductive rods. Plot (a) of FIG. 4 represents the cross polarization ratio of the first radiator with the conductive rods 150 removed, while plot (b) of FIG. 4 represents the cross polarization ratio of the first radiator when the conductive rods 150 are positioned in parallel with the arrays formed by the first radiators 100.

Comparing plots (a) and (b) in FIG. 4, it can be seen that the cross polarization ratio of the first radiator 100 has increased in plot (b) compared to plot (a). Thus, it can be observed that a base station antenna according to an embodiment of the present invention can be made to have an improved cross polarization ratio by positioning the conductive rods 150 to be in parallel with the arrays formed by the first radiators 100.

Referring to FIG. 2, on an upper portion of the balun part 110 of the first radiator 100, a metal patch 140 can be positioned. The metal patch 140 may be made from a conductive material and may be positioned in parallel with the reflector plates 300, 400. In particular, the metal patch 140 can be formed to have an area larger than the area of the upper surface of the balun part 110.

Figure 5:
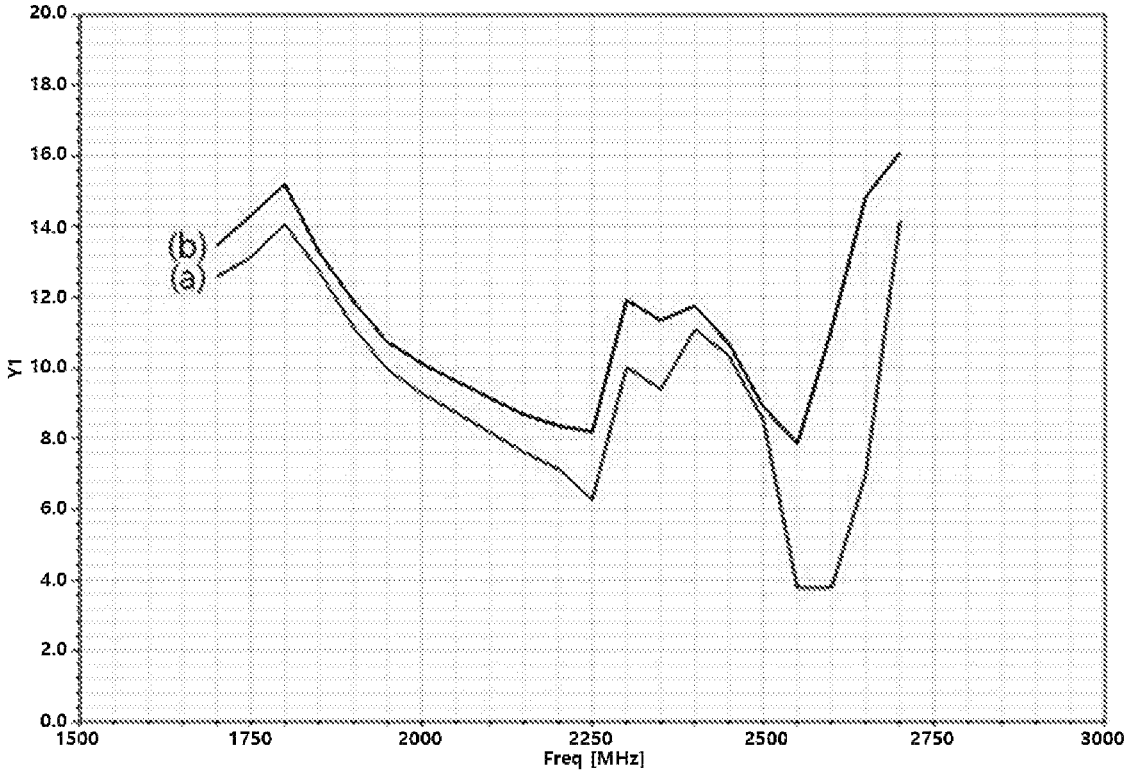
FIG. 5 is a graph representing the cross polarization ratio of a first radiator according to the placement of the metal patch.

FIG. 5 is a graph representing the cross polarization ratio of a first radiator according to the placement of the metal patch. Plot (a) of FIG. 5 represents the cross polarization ratio of the first radiator with the metal patch 140 removed, while plot (b) of FIG. 5 represents the cross polarization ratio of the first radiator when the metal patch 140 is positioned with a larger area than that of the upper surface of the balun part 110.

Comparing plots (a) and (b) in FIG. 5, it can be seen that the cross polarization ratio of the first radiator 100 has increased in plot (b) compared to plot (a). Thus, it can be observed that a base station antenna according to an embodiment of the present invention can be made to have an improved cross polarization ratio by positioning the metal patch 140 with an area larger in size than the area of the upper surface of the balun part 110.

Also, the metal patch 140 can be positioned such that its center overlaps the center of the first radiator 100. That is, the metal patch 140 can be positioned such that it does not deviate to any one side with respect to the first radiator 100. By thus forming the metal patch 140 at a proper position and in a proper size, the base station antenna according to an embodiment of the present invention can be made to have an improved cross polarization ratio.

Figure 6:
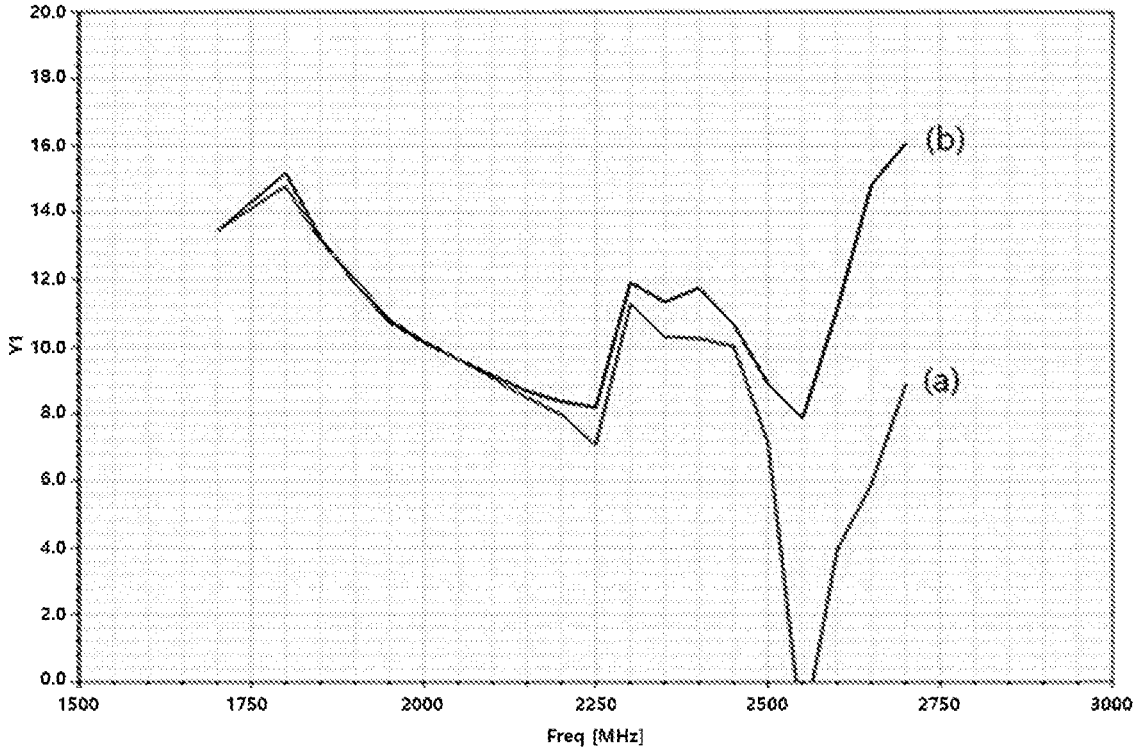
FIG. 6 is a graph representing the cross polarization ratio of a first radiator according to the position of the metal patch.

FIG. 6 is a graph representing the cross polarization ratio of a first radiator according to the position of the metal patch. Plot (a) of FIG. 6 represents the cross polarization ratio of the first radiator when the middle of the metal patch 140 does not overlap the middle of the first radiator 100, while plot (b) of FIG. 6 represents the cross polarization ratio of the first radiator when the middle of the metal patch 140 does overlap the middle of the first radiator 100.

Comparing plots (a) and (b) in FIG. 6, it can be seen that the cross polarization ratio of the first radiator 100 has increased in plot (b) compared to plot (a). Thus, it can be observed that a base station antenna according to an embodiment of the present invention can be made to have an improved cross polarization ratio by positioning the metal patches 140 such that the centers of the metal patches 140 overlap the centers of the first radiators 100.

The metal patch 140 positioned on the upper portion of the balun part 110 of the first radiator 100 can also improve the standing-wave ratio (SWR) of the base station antenna according to an embodiment of the present invention.

Furthermore, it is possible to adjust the beam width of the base station antenna according to an embodiment of the present invention by changing the sizes of the metal patches 140, the distances from the first radiators 100, etc.

A dielectric 130 can also be formed on the first radiator 100. The dielectric 130 can secure the metal patch 140 and the conductive rods 150 while keeping the metal patch 140 and conductive rods 150 electrically separated from the first radiator. Also, the dielectric 130 can contact the first reflector plate 400 so that the first radiator 100 may be electrically separated from the first reflector plate 400.

Figure 7:
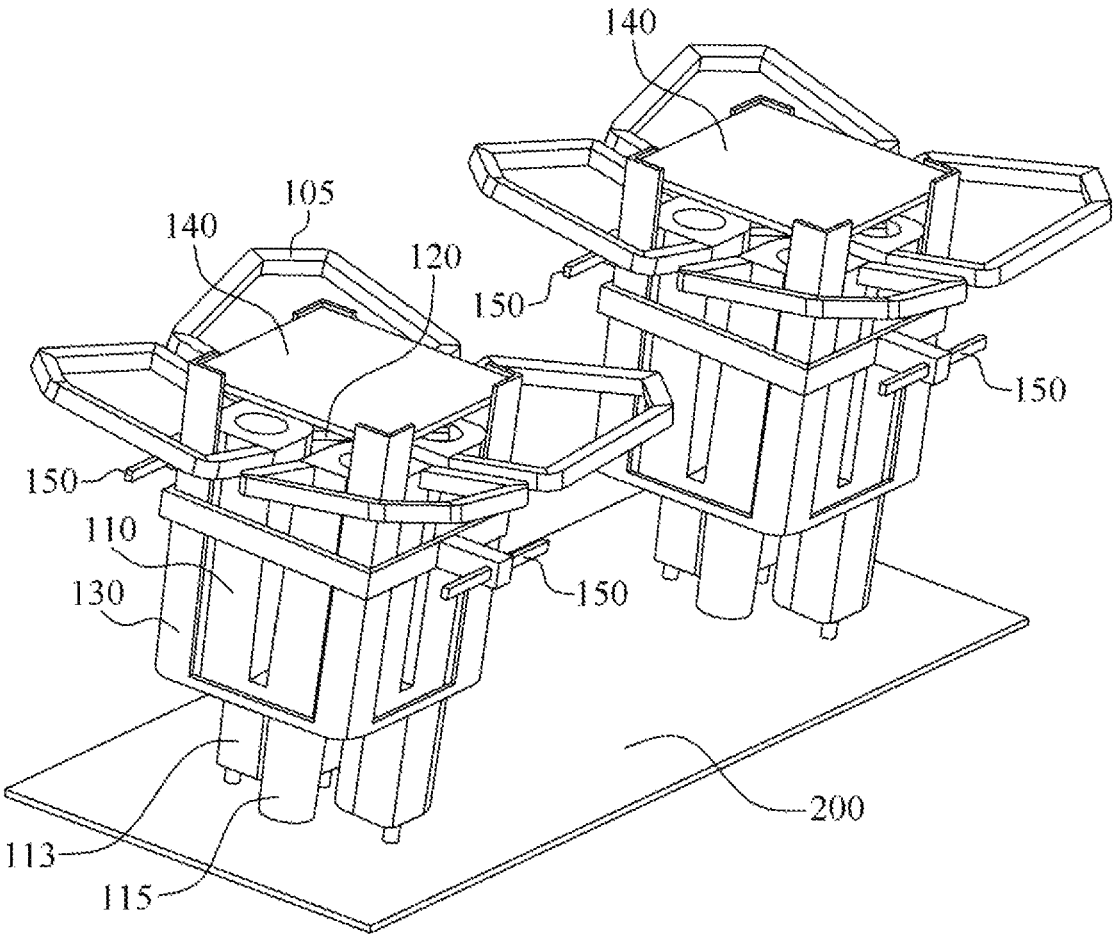
FIG. 7 is a perspective view of the connecting part between a first radiator and a circuit board in a base station antenna according to an embodiment of the present invention.

FIG. 7 is a perspective view of the connecting part between a first radiator and a circuit board in a base station antenna according to an embodiment of the present invention.

Referring to FIG. 1 and FIG. 7, a circuit board 200 can be formed under the second reflector plate 300, and circuits connecting to the first radiators 100 can be formed on the circuit board 200, so that the circuits may supply feed signals to the first radiators 100.

Referring to FIG. 7, the feed parts 113 of a first radiator 100 can be connected with the circuit board 200 under the second reflector plate 300. The feed lines 120 can connect with the circuits of the circuit board 200 through holes formed in the feed parts 113.

In particular, the first radiators applied to a base station antenna according to an embodiment of the present invention can emit dual polarizations of ±45°. Since the feed lines 120 formed in the first radiator 100 may be positioned in the holes formed in the balun part 110, the signals of +45° and −45° can be supplied with two feed lines 120, respectively, through two feed parts 113.

Figure 8:
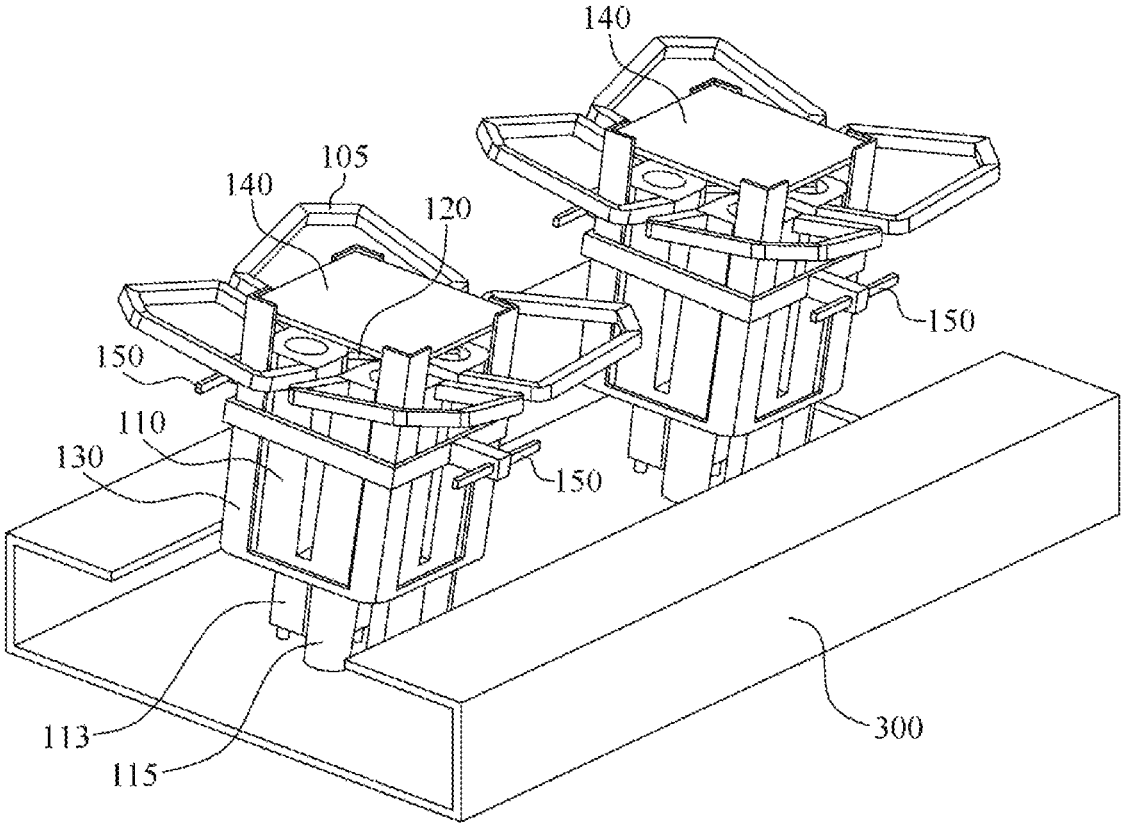
FIG. 8 is a perspective view of a first radiator and a second reflector plate in a base station antenna according to an embodiment of the present invention.

FIG. 8 is a perspective view of a first radiator and a second reflector plate in a base station antenna according to an embodiment of the present invention.

Referring to FIG. 8, the ground part 115 of the first radiator 100 can be connected with the second reflector plate 300, which may have a ground potential. In particular, the two feed lines 120 passing through the two feed parts 113 can pass through the remaining two holes in the balun part 110, excluding the feed parts 113, to connect with the ground part 115.

Referring to FIG. 1 and FIG. 8, the balun part 110 of the first radiator may pass through the first reflector plate 400 to be connected to the second reflector plate 300. In particular, the first radiator 100 may be electrically separated from the first reflector plate 400 due to the dielectric 130 formed on the balun part 110 and electrically connected to the second reflector plate 300. Thus, the first reflector plate 400 may serve as a reflector plate for improving the front-to-back ratio, and the second reflector plate 300 may be connected with the ground part 115 of the first radiator 100. As shown in the drawings, the first radiators 100 can be positioned at the middle of the C shape of the second reflector plate 300. This structure enables the base station antenna according to an embodiment of the present invention to have an improved cross polarization ratio compared to existing structures that use one reflector plate.

Such a base station antenna utilizing two reflector plates can also be implemented as a base station antenna that uses multi-band radiators.

Figure 9:
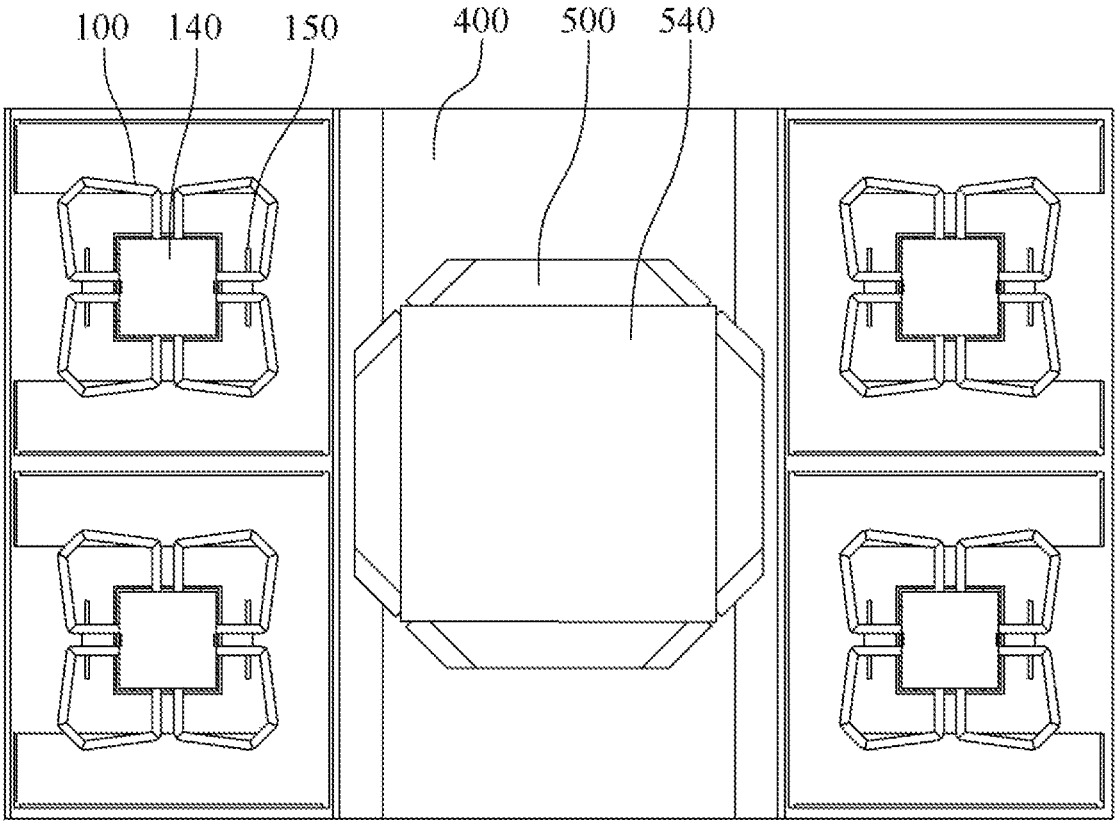
FIG. 9 is a plan view of a base station antenna according to another embodiment of the present invention.
Figure 10:
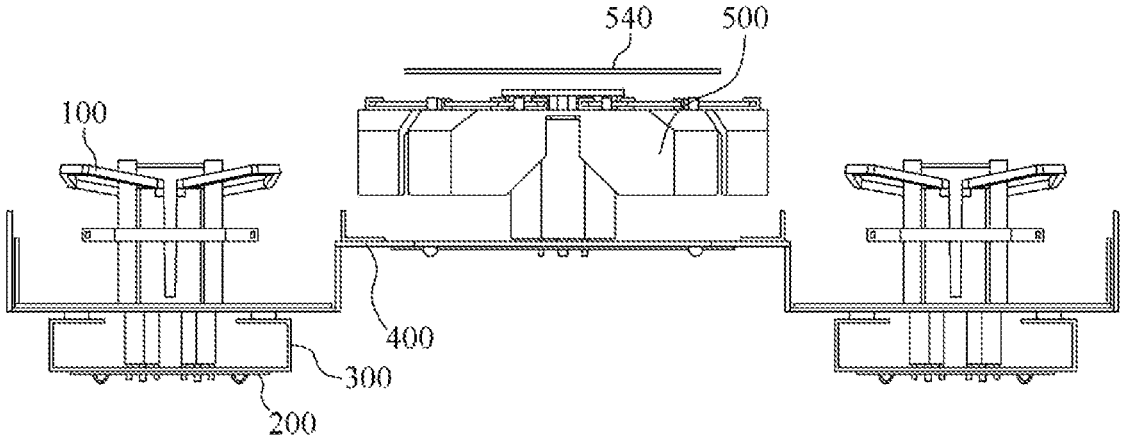
FIG. 10 is a front elevational view of a base station antenna according to another embodiment of the present invention.

FIG. 9 is a plan view of a base station antenna according to another embodiment of the present invention, and FIG. 10 is a front elevational view of a base station antenna according to another embodiment of the present invention.

Referring to FIG. 9 and FIG. 10, a base station antenna according to another embodiment of the invention can include first radiators 100, second radiators 500, a first reflector plate 400, and second reflector plates 300.

The first radiators 100 can be radiators for a high-frequency band, and the second radiators 500 can be radiators for a low-frequency band. The first radiators 100 and second radiators 500 can be arranged over the first reflector plate 400 while forming one or more arrays. As in the embodiment illustrated in the drawing, it is possible to use only one second radiator 500 as a radiator for a low-frequency band. For example, it is possible to form a second radiator 500 at the center of the base station antenna and form two arrays of first radiators 100 arranged symmetrically on either side of the second radiator 500, as in FIG. 9.

The first reflector plate 400 and the second reflector plate 300 can be made from metal materials and can have a ground potential. In particular, the first reflector plate 400 can be formed in the shape of a folded plate as in FIG. 10. The first reflector plate 400 can be shaped such that the first radiators 100 and second radiators 500, which are configured for different frequency bands, are not arranged on the same plane.

The second reflector plate 300 can be positioned under the first reflector plate 400. Although the circuits on the circuit board 200 positioned under the second reflector plate 300 can cause leaky waves that may influence the radiators, a base station antenna according to another embodiment of the invention can have the second reflector plate 300 positioned beneath the first reflector plate 400, so that the leaky waves may be blocked by the first reflector plate 400, and the influence of the leaky waves on the second radiator 500 can be minimized.

Also, the second reflector plate 300 can be formed under any one of the first radiators 100 and the second radiator 500. For instance, in the example shown in FIG. 10, the second reflector plates 300 are formed under only the first radiators.

Circuit boards 200 can be formed under the first radiators 100, i.e. on the lower surfaces of the second reflector plates 300, to supply the first radiators 100 with feed signals. Obviously, a circuit board for the second radiator 500 can be formed under the second radiator 500 to supply feed signals to the second radiator 500.

Although the first radiators 100 of a base station antenna according to another embodiment of the present invention may be arranged over the first reflector plate 400, the first radiators 100 can be prevented from being electrically connected with the first reflector plate 400 by the dielectrics 130 but can penetrate through the first reflector plate 400 to be electrically connected with the second reflector plates 300 that are positioned under the first reflector plate 400.

Thus, the connection structure between the first radiators 100 and the first reflector plate 400 and second reflector plates 300 for a base station antenna according to another embodiment of the invention can be similar to that used in the base station antenna of the previously described embodiment of the invention.

Also, the first radiators 100 of a base station antenna according to another embodiment of the invention can include metal patches 140 and conductive rods 150 such as those of the first radiators 100 in the base station antenna of the previously described embodiment of the invention. The metal patches 140 and conductive rods 150 of a base station antenna according to another embodiment of the invention can be placed in the same positions and can perform the same functions as the metal patches 140 and conductive rods 150 in the base station antenna of the previously described embodiment of the invention.

In a base station antenna according to another embodiment of the invention, the conductive rods 150 can be positioned in parallel with the arrays formed with the first radiators 100, the metal patches 140 can be positioned such that the center of each metal patch 140 overlaps the center of the respective first radiator 100, and the metal patches 140 can be formed such that the area of each metal patch 140 is larger in size than the area of the upper surface of the respective balun part 110. Such sizes and positions of the conductive rods 150 and metal patches 140 can provide an improved cross polarization ratio for the base station antenna according to another embodiment of the invention, as observed from the graphs of FIG. 4 to FIG. 6.

Moreover, in the base station antenna according to another embodiment of the invention, a metal patch 540 can be positioned also on the upper portion of the second radiator 500 configured for the low-frequency band.

While the present invention is described above by way of limited embodiments and drawings that refer to particular details such as specific elements, etc., these are provided only to aid the general understanding of the present invention. The present invention is not to be limited by the embodiments above, and the person having ordinary skill in the field of art to which the present invention pertains would be able to derive numerous modifications and variations from the descriptions and drawings above. Therefore, it should be appreciated that the spirit of the present invention is not limited to the embodiments described above. Rather, the concepts set forth in the appended scope of claims as well as their equivalents and variations are encompassed within the spirit of the present invention.

What is claimed is:

1. A base station antenna comprising:

a first reflector plate made of a metal material;

at least one first radiator formed on the first reflector plate, the first radiator configured for a first frequency band;

at least one second radiator formed on the first reflector plate, the second radiator configured for a second frequency band;

a dielectric electrically separating the first radiator and the first reflector plate; and a second reflector plate of a metal material formed under the first reflector plate, wherein, the first radiator is not connected with the first reflector plate and penetrates through the first reflector plate to be electrically connected with the second reflector plate directly, and the second radiator is electrically connected with the first reflector plate, wherein the first frequency band is different form the second frequency band, and wherein the first reflector plate and the second reflector plate have a ground potential.

2. The base station antenna of claim 1, wherein the first radiator has a balun part formed thereon, the balun part having a plurality of holes formed therein, the balun part penetrates through the first reflector plate to be electrically connected with the second reflector plate, and the dielectric is formed in contact with the balun part and the first reflector plate.

3. The base station antenna of claim 2, wherein the first radiator is supplied with feed signals by way of a coupling method from a feed line, the feed line penetrating through a hole of the balun part.

4. The base station antenna of claim 3, wherein the second reflector plate has a cross section shaped as a letter C, and the first reflector plate and the second reflector plate are electrically connected.

5. The base station antenna of claim 4, wherein the first radiator is positioned at a middle of the C shape of the second reflector plate.

6. The base station antenna of claim 1, wherein a circuit board is formed under the second reflector plate to provide feed signals to the first radiator.

7. The base station antenna of claim 1, wherein the first frequency band is of a higher frequency band than the second frequency band, and wherein the first radiator and the second radiator are not arranged on a same plane.

8. The base station antenna of claim 7, wherein the first radiator and the second radiator radiate dual polarizations.

9. A base station antenna comprising:

a first reflector plate made of a metal material;

one or more radiators formed over the first reflector plate;

a dielectric electrically separating the one or more radiators and the first reflector plate; and a second reflector plate formed under the first reflector plate, wherein the one or more radiators are not connected with the first reflector plate and penetrate through the first reflector plate to be electrically connected with the second reflector plate directly, wherein the first reflector plate is shaped such that the one or more radiators are configured for different frequency band and the one or more radiators are not arranged on a same plane, wherein the first frequency band is different form the second frequency band, and wherein the first reflector plate and the second reflector plate have a ground potential.

10. The base station antenna of claim 9, wherein the one or more radiators have a balun part formed thereon, the balun part having a plurality of holes formed therein, the balun part penetrates through the first reflector plate to be electrically connected with the second reflector plate, and the dielectric is formed in contact with the balun part and the first reflector plate.

11. The base station antenna of claim 10, wherein the one or more radiators are supplied with feed signals by way of a coupling method from a feed line, the feed line passing through a hole of the balun part.

12. The base station antenna of claim 11, wherein the second reflector plate has a cross section shaped as a letter C, and the first reflector plate and the second reflector plate are electrically connected.

13. The base station antenna of claim 12, wherein the one or more radiators are positioned at a middle of the C shape of the second reflector plate.

14. The base station antenna of claim 13, wherein circuit boards are formed on the lower surface of the second reflector to supply feed signals to the one or more radiators.

15. The base station antenna of claim 2, wherein radiating parts are formed, at an upper end of the balun part, extending along a sideward direction that is non-parallel with the first and second reflector plates, wherein the radiating parts have a shape of a multiple number of rings.

* * * * *